US005767655A

United States Patent [19]

Ostendorff et al.

[11] Patent Number: 5,767,655

[45] Date of Patent: Jun. 16, 1998

[54] PIT-STOP RECHARGER FOR FAST RECHARGE TOY VEHICLE

[75] Inventors: Eric C. Ostendorff, Torrance; Lena Bartok, Signal Hill, both of Calif.

[73] Assignee: Mattel, Inc., El Segundo, Calif.

[21] Appl. No.: 700,624

[22] Filed: Aug. 16, 1996

[51] Int. Cl.[6] ..... H01M 10/44; A63H 18/00

[52] U.S. Cl. ..... 320/2; 446/429

[58] Field of Search ..... 320/2; 446/429, 446/275, 433, 435

[56] References Cited

U.S. PATENT DOCUMENTS

| | | | |
|---|---|---|---|
| 3,735,525 | 5/1973 | Freed | 446/429 |
| 3,751,847 | 8/1973 | Neuhierl | 446/429 |
| 3,970,309 | 7/1976 | Sato | 463/59 |
| 4,697,133 | 9/1987 | Pergandis | 320/2 |

*Primary Examiner*—Peter S. Wong
*Assistant Examiner*—Gregory J. Toatley, Jr.
*Attorney, Agent, or Firm*—Roy A. Ekstrand

[57] ABSTRACT

A toy vehicle is operatively driven by an electric motor having a storage capacitor coupled in parallel therewith. The capacitor and motor are coupled to a pair of underside contacts on the toy vehicle for charging. The toy vehicle underside further includes an aperture and an elongated slot. A cooperating charger/launcher includes a vehicle receiving surface upon which a wheel pedestal is positioned between the area at the rear of the vehicle for raising the vehicle rear wheels. The charger/launcher further includes an interlock post received within the aperture formed on the vehicle undersurface and a safety rib received within the elongated slot of the vehicle. A pair of electrical contacts are positioned on each side of the protective rib and are coupled to a battery supply within the launcher for charging the vehicle capacitor. A pit-stop recharger includes a pivotable gate and pit area within which a second recharging apparatus is provided.

5 Claims, 3 Drawing Sheets

PIT-STOP RECHARGER FOR FAST RECHARGE TOY VEHICLE

CROSS REFERENCE TO RELATED APPLICATION

This application is related to a copending application filed Aug. 16, 1996 entitled Charger/Launcher for Fast Recharge Toy Vehicle which is assigned to the assignee of this application.

FIELD OF THE INVENTION

This invention relates generally to rechargeable electrically powered toy vehicles and particularly to the charger apparatus used therein.

BACKGROUND OF THE INVENTION

Rechargeable toy vehicles have been provided for many years and have, for the most part, enjoyed substantial commercial success. Usually, such toy vehicles includes a rechargeable battery supported within the toy vehicle together with a small DC motor which is operatively coupled to one or more of the toy vehicle vehicles to power the toy vehicle. Often a track or race course is provided for use with such rechargeable toy vehicles. To further reduce the cost and complexity as well as size of such electrically powered toy vehicles, playsets often further utilize vehicles without steering capability and rely upon raised side walls formed on the track portions to confine the vehicle within the track circuit. As a result, the electrically powered toy vehicle rapidly circulates upon the track being guided by the raised side walls and maintained within the track circuit or loop. Most such toy vehicles require a substantial time period for battery charging and often interchangeable or replaceable batteries are utilized.

A recently developed electrically powered toy vehicle has improved the recharge time of electrically powered toy vehicles in that it utilizes a toy vehicle having a large capacitor in parallel with the electric motor. The capacitor and motor in parallel combination are coupled to a pair of charging terminals extending downwardly from the vehicle lower surface. The motor is directly coupled to the drive wheels of the vehicle without the aid of intervening clutch mechanism. Thus, the vehicle wheels turn in combination with the rotation of the electric motor. The charger/launcher for such capacitively powered electric toy vehicle utilizes a receiving surface for resting the vehicle thereon together with a pedestal at the rear portion of the vehicle which raises the vehicle wheels off the launcher surface. A pair of electrical contacts extend upwardly from the launcher surface and are aligned with the corresponding terminals of the toy vehicle such that electrical connection is made between the launcher and the vehicle when the toy vehicle rests upon the launcher. The extending contacts of the launcher are coupled to a plurality of batteries supported within the launcher.

Thus, when the toy vehicle is rested upon the launcher with the rear wheels raised above the launcher surface and such that contact is made with the launcher battery supply, the capacitor within the toy vehicle is rapidly charged. Because of the direct clutchless coupling of the motor to the drive wheels, the rear wheels of the vehicle spin in the air above the launcher surface during the charging process. Once the capacitor has been sufficiently charged, the vehicle is moved forwardly on the launch surface allowing the rear wheels to come into contact with the launcher surface and permitting the vehicle to propel itself from the launcher and onto the track. The stored energy within the capacitor supplies electrical power to the vehicle motor allowing the toy vehicle to complete one or more circuits of the track.

Notwithstanding the commercial potential of such capacitor powered toy vehicles, there remains a need in the art for additional features for use therewith.

For these reasons, a continuing need in the art arises for evermore improved accessories for use with capacitively powered toy vehicles and launchers which overcomes the limitations and shortcomings of the prior art devices.

SUMMARY OF THE INVENTION

Accordingly, it is a general object of the present invention to provide an improved charger accessory for fast recharge toy vehicles. It is a more particular object of the present invention to provide an improved charger accessory for fast recharge toy vehicles which provides more interesting operation of the vehicle and the charger/launcher.

In accordance with the present invention, there is provided a pit-stop recharger for use in combination with a toy vehicle track and a toy vehicle having a capacitor and electric motor drive together with a pair of underside vehicle contacts, the pit-stop recharger comprising: a pit area adjacent the track; a gate pivotable between a first position diverting the toy vehicles from the track into the pit area and a second position closing the pit area; a pivotable stop arm for captivating a toy vehicle within the pit area; and means for applying a recharging voltage to the pair of underside contacts of a toy vehicle captivated within the pit area.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
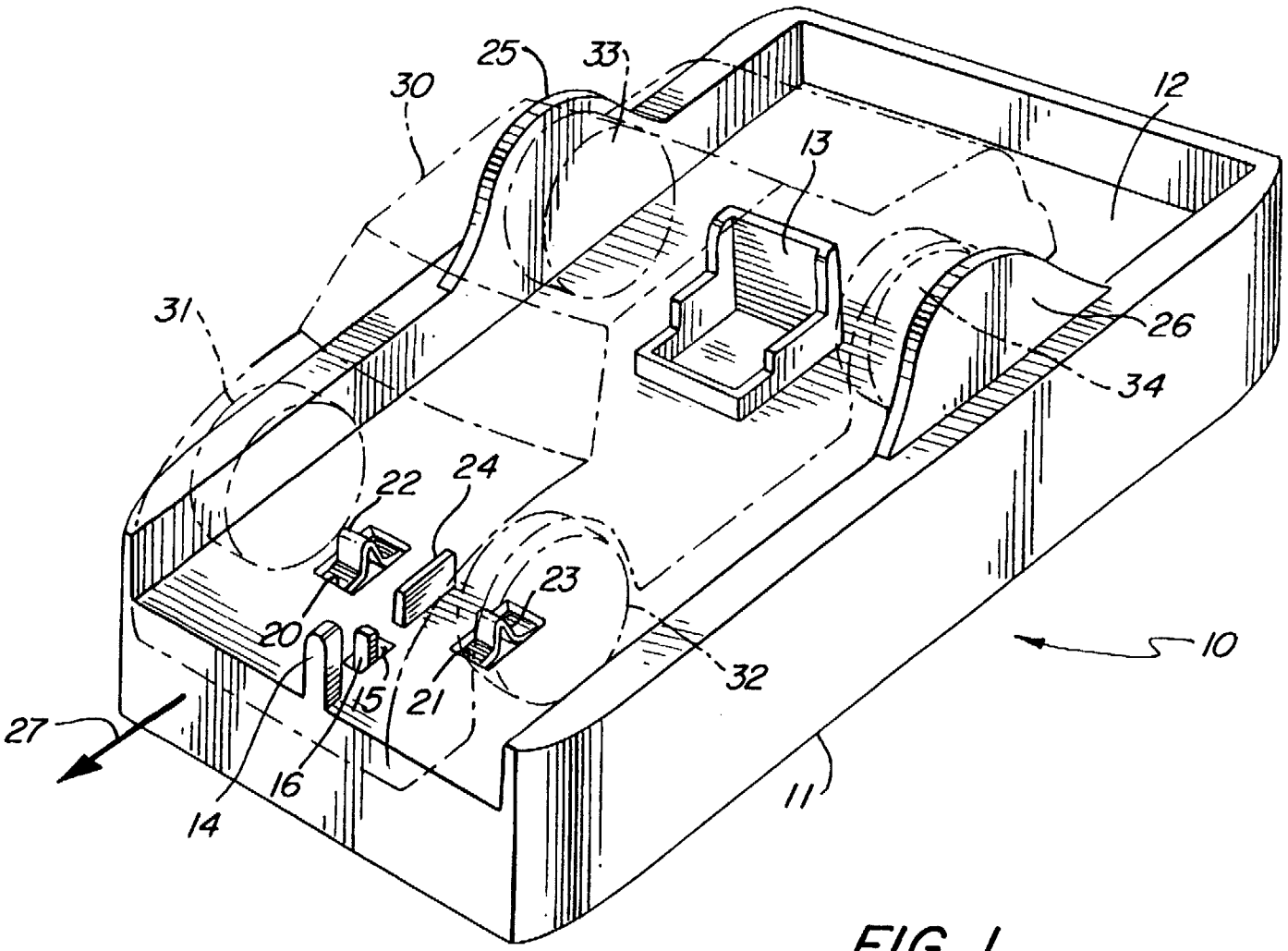
FIG. 1 sets forth a perspective view of a charger/launcher for fast recharge toy vehicles constructed in accordance with the present invention and showing a dashed-line outline of a cooperating rechargeable toy vehicle.
Figure 2:
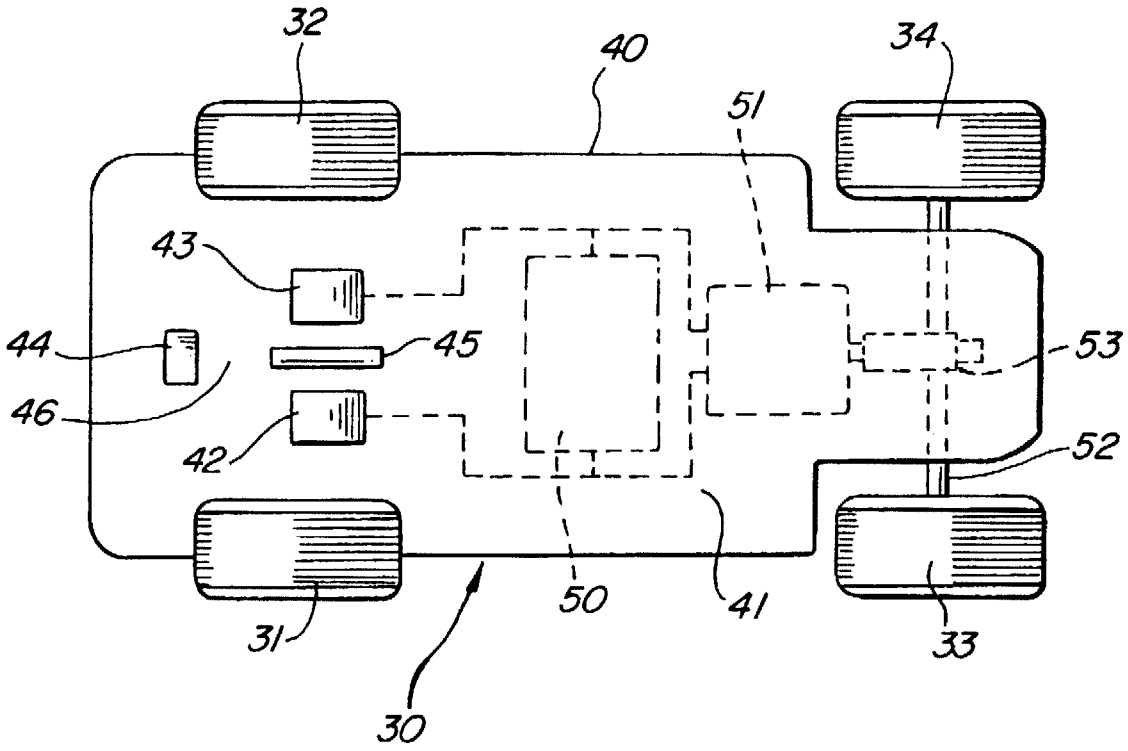
FIG. 2 sets forth a bottom view of a fast recharge toy vehicle of the type utilized in the present invention charger/launcher.

FIG. 1 sets forth a perspective view of a charger/launcher constructed in accordance with the present invention and generally referenced by numeral 10. Also shown in FIG. 1 in dashed outline is a simplified view of a toy vehicle cooperating with the present invention charger/launcher which, as is better seen in FIG. 2, is powered by the combination of a charging capacitor and electric motor. For purposes of illustration in FIG. 1, toy vehicle generally referenced by numeral 30 is in dashed outline to facilitate the observation and illustration of charger/launcher 10. Charger/launcher 10 includes a base 11 defining a vehicle receiving surface 12 and a pair of upwardly extending shields 25 and 26. The forward portion of surface 12 is open and supports an upwardly extending interlock post 14. Surface 12 of base 11 further defines an aperture 15 aligned with interlock post 14 and a pair of spaced apart elongated apertures 20 and 21. An elongated raised protective rib 24 is aligned with aperture 15 and interlock post 14 and is positioned between apertures 20 and 21. Base 11 further defines a vehicle wheel pedestal 13 configured to cooperate with the underside of toy vehicle 30 to raise the rear wheels of toy vehicle 30 when the toy vehicle is received upon charger/launcher 10. Suffice it to note here that toy vehicle 30 includes front wheels 31 and 32 and rear wheels 33 and 34. It should be further noted as is set forth below in greater details that rear wheels 33 and 34 comprise the power driven wheels of toy vehicle 30.

A pair of spring supported contacts 22 and 23 are supported within base 11 by conventional fabrication means and extend upwardly through apertures 20 and 21 respectively on either side of protective rib 24. In accordance with an important aspect of the present invention, rib 24 extends above contacts 22 and 23. A spring switch 16 extends upwardly through aperture 15 and is utilized in providing a safety interlock switch for charger/launcher 10 which interrupts the power coupling to contacts 22 and 23 in the absence of a toy vehicle upon surface 12.

In the anticipated use of the present invention charger/launcher, a toy vehicle 30 is received upon vehicle receiving surface 12 such that a pair of underside electrical contacts are aligned with and brought into contact with spring contacts 22 and 23. As described below in greater detail, an aperture formed on the underside of vehicle 30 (aperture 44 in FIG. 2) receives interlock post 14 to maintain the position of toy vehicle 30 upon wheel pedestal and surface 12 during the charging process. Because the rear wheels of toy vehicle 30 rotate when electrical power is coupled to the vehicle, wheel pedestal 13 raises wheels 33 and 34 upwardly from surface 12 to maintain vehicle 30 within the charger/launcher. As is also set forth below in greater detail, the undersurface of vehicle 30 defines an elongated slot 45. Slot 45 receives protective rib 24 during the charging process to allow the undersurface contacts of vehicle 30 to fully engage spring contacts 22 and 23.

Finally, the undersurface of toy vehicle 30 forces spring switch 16 downwardly completing the charging circuit within charger/launcher 10 and allowing electrical energy to flow through contacts 22 and 23 charging the vehicle capacitor in preparation for operation.

In accordance with an important aspect of the present invention, the combination of interlock post 14 and protective rib 24 prevents a flat object such as a coin or the like placed upon the area of charger/launcher 10 which supports contacts 22 and 23 from simultaneously touching both spring contacts. Thus, the inadvertent or mischievous shorting of spring contacts 22 and 23 by a coin or similar flat object is prevented. In further accordance with the present invention, the position of interlock post 14 and protective rib 24 cooperate to prevent a toy vehicle such as toy vehicle 30 from being placed in a reverse position upon charger/launcher 10. In this latter feature, and with temporary reference to FIG. 2, aperture 44 cooperates to ensure that a reverse direction vehicle cannot be actively placed upon the charger/launcher and provide electrical connection in reverse polarity.

FIG. 2 sets forth a bottom view of toy vehicle 30. Toy vehicle 30 includes a chassis 40 which supports front wheels 31 and 32 and a rear axle 52. Rear axle 52 in turn supports rear wheels 33 and 34. Chassis 40 defines a bottom surface 41 supporting a pair of extending electrical contacts 42 and 43. Bottom surface 41 further defines an aperture 44 and an elongated slot 45. A surface portion 46 extends between aperture 44 and slot 45. In accordance with the above-described capacitively driven toy vehicle known in the prior art, toy vehicle 30 includes a capacitor 50 electrically coupled to contacts 42 and 43 together with an electric motor 51 electrically connected in parallel with capacitor 50. Motor 51 in turn is coupled to a drive gear mechanism 53 which engages axle 52. Through the operation of drive gear mechanism 53, rotation of motor 51 causes a corresponding rotation of axle 52 and rear wheels 33 and 34 to drive toy vehicle 30.

In accordance with the present invention and as described above, aperture 44 receives interlock post 14 (seen in FIG. 1) when toy vehicle 30 is placed upon the charger launcher. As is also described above, slot 45 receives elongated protective rib 24 (seen in FIG. 1). The intervening surface portion 46 on bottom surface 41 of toy vehicle 30 forces spring switch 16 downwardly (seen in FIG. 1) to turn on the charging circuit within the charger/launcher.

It should be noted that the present invention provides additional safety features not found in the prior art charger/launcher and toy vehicle combination described above in the Background of the Invention. It will be understood that, except for the addition of safety elements which comprise protective rib 24, interlock post 14 and spring switch 16 on charger/launcher 10 (seen in FIG. 1) together with cooperating aperture 44 and slot 45 (seen in FIG. 2); the remaining fabrication of both charger/launcher 10 and toy vehicle 30 correspond to the prior art capacitively driven toy vehicle described above in Applicant's Background of the Invention. In accordance with the present invention, the added safety and protective elements thus provided ensure the safe and effective operation of the charger/launcher and its cooperating toy vehicle.

Figure 3:
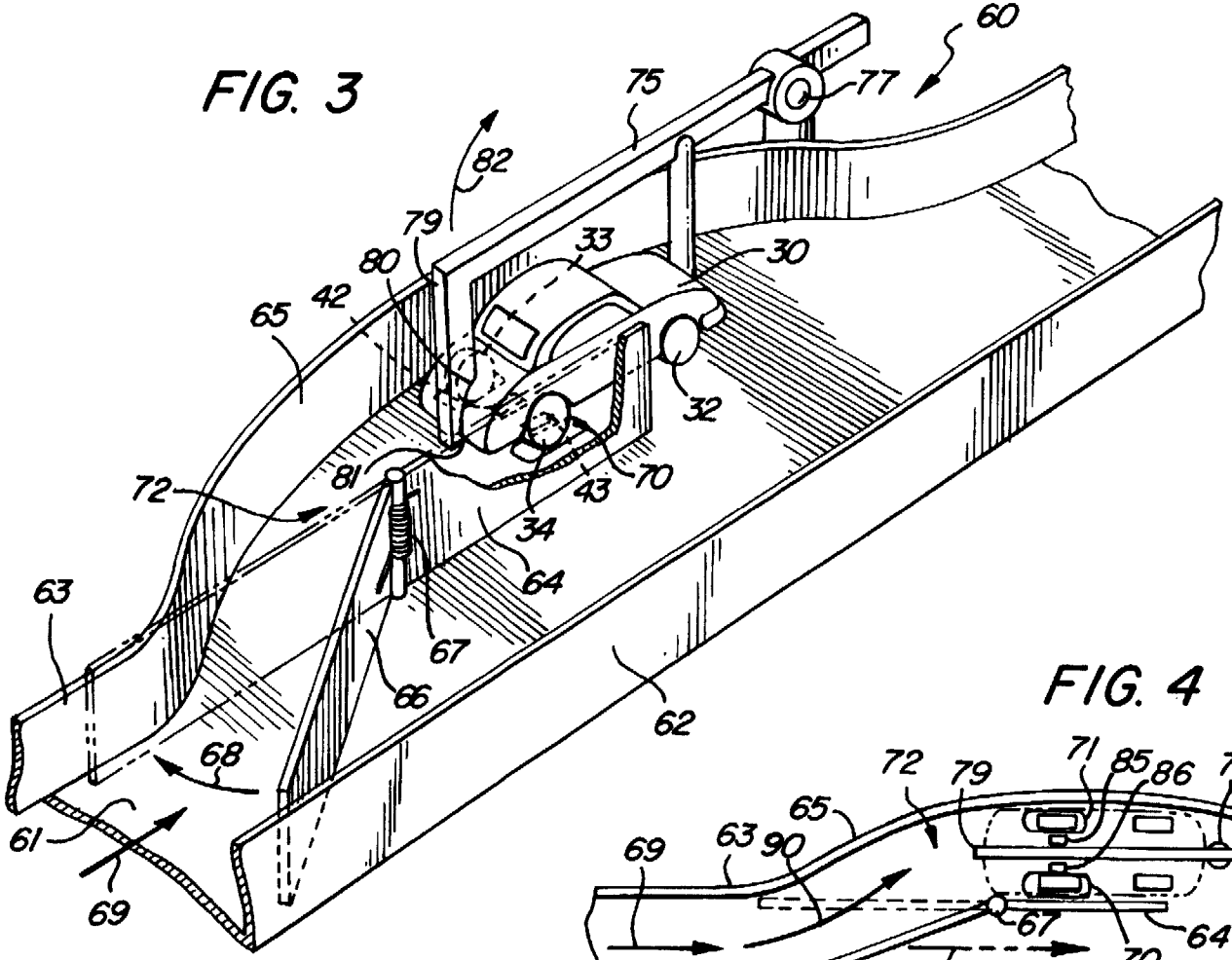
FIG. 3 sets forth a perspective view of the present invention pit-stop recharger.

FIG. 3 sets forth a perspective view of a pit-stop recharger constructed in accordance with the present invention and generally referenced by numeral 60. While not seen in FIG. 3, it will be understood by those skilled in the art that pit-stop recharger 60 is preferably coupled to a conventional track loop or other vehicle guiding track course. Thus, a portion of the track loop or track course referenced as track 61 includes spaced apart vertical walls 62 and 63 which guide the toy vehicle in a travel direction indicated by arrow 69. A pit area 72 formed between a wall 64 and a curved pit wall 65 is provided with a pivotable gate 66. Gate 66 is pivotally secured to wall 64 by a spring hinge 67. Spring hinge 67 performs the dual functions of allowing gate 66 to be pivoted with respect to wall 64 between the solid-line position shown and the dashed-line position also shown. Further, spring hinge 67 provides a spring force which urges gate 66 in the direction indicated by arrow 68 to the dashed-line position shown.

Figure 4:
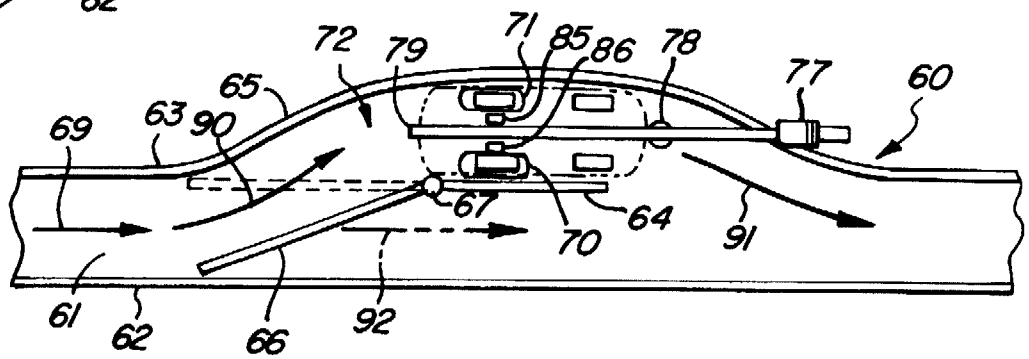
FIG. 4 sets forth a top view of the present invention pit-stop recharger.

Within pit area 72, a pair of spaced apart recesses 70 and 71 (the latter seen in FIG. 4) are formed together with a pair of electrical contacts 85 and 86 (also seen in FIG. 4).

Pit stop recharger 60 further includes a post 76 having a pivot 77 supported thereon. A vehicle retainer arm 75 is secured to pivot 77 and thus is pivotable with respect to post 76. Retainer arm 75 includes a downwardly extending stop 78 and a downwardly extending push rod 79. The spacing between stop 78 and push rod 79 accommodates the capturing of a toy vehicle 30 constructed as described above. Push rod 79 defines a notch 80 captivating the rear portion of vehicle 30 and an underside tab 81 extending beneath the toy vehicle. Toy vehicle 30 as described above includes a pair of underside contacts 42 and 43 and rear drive wheels 34 and 33.

In operation, gate 66 is normally positioned as shown in dashed-line representation closing pit area 72 from toy vehicle access such that toy vehicles simply pass by pit area 72 while traversing track 61. When it is desired to recharge a toy vehicle using a pit stop, the user pivots gate 66 to the open position shown in FIG. 3. With gate 66 thus positioned, the next oncoming toy vehicle is guided by gate 66 and diverted into pit area 72. When the toy vehicle reaches the position shown in FIG. 3, the rear wheels thereof are received within recesses 70 and 71 and retainer arm 75 is pivoted to the lowered position shown in FIG. 3. Stop 78 contacts the front of vehicle 30 causing it to stop in the pit position shown. As retainer arm 75 continues to be pivoted downwardly, notch 80 and tab 81 engage the rear portion of toy vehicle 30 captivating the vehicle to retain wheels 33 and 34 within recesses 70 and 71. This allows the wheels to rotate without propelling the vehicle. As vehicle retainer arm 75 is continued in a downward pivoting motion, notch 80 forces contacts 42 and 43 of vehicle 30 against pit-stop charging contacts 70 and 71 completing the above-described electric circuit and recharging the capacitor within vehicle 30. Once vehicle 30 has been diverted into pit area 72, gate 66 is released returning to the dashed-line position shown and subsequent toy vehicles pass alongside pit area 72. As the charging process is complete, vehicle retainer arm 75 is pivoted upwardly in the direction indicated by arrow 82 releasing vehicle 30 and nudging it forwardly through the action of tab 81 on the underside of the vehicle. The vehicle wheels having continued to spin during the charging process as described above, a forward nudge of vehicle 30 and the removal of stop 78 causes vehicle 30 to again move forwardly under its own power. Pit wall 65 is curved toward the main path of track 69 and thus vehicle 30 is guided back onto the track and continues its travel.

FIG. 4 sets forth a top view of pit-stop recharger 60 showing track 69 having walls 62 and 63. Pit area 72 is formed by curved pit wall 65 and wall 64. Gate 66, as described above, is supported by spring hinge 67. Within pit area 72, a pair of recesses 70 and 71 together with contacts 85 and 86 are formed. Retainer arm 75 pivotally supported at pivot 77 includes a stop 78 and a push rod 79 for captivating a toy vehicle. In the anticipated operation of the present invention described above, a toy vehicle traveling in the direction indicated by arrow 69 upon track 61 is diverted in the manner shown by arrow 90 against gate 66 and captivated within pit area 72 for recharging. After recharge, arm 75 is raised releasing the toy vehicle to be guided outwardly in the direction indicated by arrow 91 back onto track 61. With gate 66 released, spring hinge 67 returns it to the dashed-line position shown and toy vehicles flow past pit area 72 in the manner indicated by dashed-line arrow 92.

What has been shown is an improved accessory providing a pit stop recharger for fast recharge toy vehicles. The addition of a pit stop recharger facilitates a further amusement and entertainment aspect of the operation of toy vehicles upon a racetrack or track loop.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A pit-stop recharger for use in combination with a toy vehicle track and a toy vehicle having a capacitor and electric motor drive together with a pair of underside vehicle contacts, said pit-stop recharger comprising:

a pit area adjacent said track;

a gate pivotable between a fist position diverting said toy vehicles from said track into said pit area and a second position closing said pit area;

a pivotable stop arm having a vehicle retainer arm pivoting between a horizontal position and a vertical position, a stop arm and a push rod for captivating a toy vehicle within said pit area, said stop arm and said push rod extending from said vehicle retainer arm in a common direction and spaced apart by approximately a vehicle length such that in said horizontal position said stop arm blocks the front of a toy vehicle while said push rod exerts a downward force on the rear thereof; and means for applying a recharging voltage to said pair of underside contacts of a toy vehicle captivated within said pit area.

2. A pit-stop recharger as set forth in claim 1 wherein said push rod defines a notch for conforming to and captivating a toy vehicle.

3. A pit-stop recharger as set forth in claim 2 wherein said pivotable stop arm includes a support post positioned external to said pit area.

4. A pit-stop recharger as set forth in claim 3 wherein said pit area includes a curved pit wall adjacent the track and an interior wall positioned between the track and said pit wall.

5. A pit-stop recharger as set forth in claim 4 wherein said gate is pivotally supported by said interior wall.

* * * * *